US005857249A

United States Patent [19]

Todd

[11] Patent Number: 5,857,249

[45] Date of Patent: Jan. 12, 1999

[54] YARN TREATING JET HAVING A FLOW CONTROL PLATE

[75] Inventor: Maurice Cornelius Todd, Chadds Ford, Pa.

[73] Assignee: E. I. du Pont de Nemours and Company, Wilmington, Del.

[21] Appl. No.: 12,863

[22] Filed: Jan. 23, 1998

[51] Int. Cl.[6] ..... D02G 1/16

[52] U.S. Cl. ..... 28/276; 28/271

[58] Field of Search ..... 28/271, 272, 273, 28/274, 275, 276; 57/333, 350

[56] References Cited

U.S. PATENT DOCUMENTS 3,525,134 8/1970 Coon ..... 28/273

5,157,819 10/1992 Hodan ..... 28/271

5,325,572 7/1994 Dickson, III et al. ..... 28/271

5,469,609 11/1995 Beifuss ..... 28/271

*Primary Examiner*—Michael A. Neas

*Assistant Examiner*—Larry D. Worrell, Jr.

[57] ABSTRACT

A jet for treating a yarn with a fluid has a flow control plate having a first and a second flow control opening. The flow control openings are located in the plate such that when the plate is mounted between the jet body and the manifold body, at least one, but preferably both, of the flow control openings in the plate at least partially overlap the inlet end of one (or both) of the fluid supply channels, thereby to modify the fluid flow area presented to the manifold by the fluid supply channel(s).

8 Claims, 3 Drawing Sheets

YARN TREATING JET HAVING A FLOW CONTROL PLATE

BACKGROUND OF THE INVENTION

1. Field of the Invention

The present invention relates to a jet apparatus for treating a yarn with a treatment fluid, such as hot gas or steam, and in particular, to a jet apparatus that includes a flow control plate whereby the supply of treatment fluid to the jet may be adjustably controlled.

2. Description of the Prior Art

In the manufacture of synthetic thermoplastic yarn it is known that bulk and interlace may be imparted to the yarn by directing a heated treatment fluid to opposite sides of a yarn as it travels along a passage formed within a jet body. U.S. Pat. No. 3,525,134 (Coon) exemplifies such a dual impingement yarn treatment jet. The jet structure is formed from a jet body having a conjoinable cover. One surface of the jet body has the yarn passage and associated lateral supply conduits precisely machined therein. Treatment fluid is supplied to the lateral supply conduits from supply channels that extend into the jet body from the machined surface. The supply channels typically communicate with a common supply manifold. The supply manifold may be bored into the jet body or formed in a separate manifold body which is itself attachable to the jet body. The relative sizing of the various regions of the yarn passage and the associated conduits and supply channels permits the flow of treatment fluid impinging on the yarn to be precisely controllable. Owing to the care which must be exercised in forming the passage and associated conduits and channels, fabrication of a yarn treatment jet is time consuming and expensive.

In some instances, however, it may occur that the amount of interlace imparted to a yarn by a jet may become excessive. Of course, replacing the jet body with an alternative jet which is engineered to produce a different level of interlace is a direct expedient for altering the interlace level. However, owing to the cost associated with the fabrication of a jet, this alternative is not seen as economically favorable.

Alternatively, it is known that an imbalance in the flow of treatment fluid to opposite sides of the yarn has the effect of reducing the amount of interlace imparted to the yarn. U.S. Pat. No. 5,325,572 (Dickson et al.), assigned to the assignee of the present invention, discloses a jet structure having flow adjustment devices arranged to alter flow through the fluid supply channels and/or in the supply conduits.

In view of the foregoing it is believed desirable to provide an alternative jet structure wherein the flow of treatment fluid may be more easily adjusted so that the relative balance between the flow to the two opposing sides of the yarn may be selectably controlled.

SUMMARY OF THE INVENTION

The invention relates to an improvement to a jet for treating a yarn with a fluid such as air or steam. The treatment jet includes a jet body member and a conjoinable manifold body. The jet body has a yarn passage formed in one surface thereof, while the manifold body has a fluid supply manifold formed therein. First and second fluid conduits are also formed in the first surface of the jet body, with each fluid conduit intersecting the yarn passage for conducting a treatment fluid thereto. First and second fluid supply channels extend through the jet body from the first to the opposed second surface thereof. Each fluid supply channel has an inlet end and an outlet end. The outlet end of each fluid supply channel is in fluid communication with a respective one of the fluid supply conduits. The inlet end of each fluid supply channel has a predetermined fluid flow area associated therewith. When the jet body is joined to the manifold body the inlet end of each of the fluid supply channels is in fluid communication with the supply manifold.

The jet is improved in accordance with the present invention by the provision of a flow control plate having a first and a second flow control opening therein. The flow control openings are located in the plate such that when the plate is mounted between the jet body and the manifold body, at least one, but preferably both, of the flow control openings in the plate at least partially overlap the inlet end of one (or both) of the fluid supply channels, thereby to modify the fluid flow area presented to the manifold by the fluid supply channel(s).

In a preferred alternative plate structure at least one of the openings in the plate has a fluid flow area that is smaller than the fluid flow area presented to the manifold by a corresponding one of the fluid supply channels. The flow control openings are located in the plate such that when the plate is mounted between the jet body and the manifold body one (or both) of the openings in the plate coaxially register with one of the fluid supply channels. Preferably, the fluid flow area of the first opening in the plate is different from the fluid flow area of the second opening in the plate.

The present invention also contemplates a plate structure which may serve to convert a dual impingement jet to single impingement jet. In this alternative structure the plate has a single flow control opening therethrough. The flow control opening is located in the plate such that when the plate is mounted intermediate the jet body and the manifold body the inlet end of one of the fluid supply channels communicates with the opening in the plate, while the inlet end of the other fluid supply channel is blocked by the plate.

Any of the various plate structures may be interchangeably mounted between the jet body and the manifold body.

DESCRIPTION OF THE DRAWINGS

The invention will be more fully understood from the following detailed description thereof, taken in connection with the accompanying drawings, which forms a part of this application, and in which.

DETAILED DESCRIPTION OF THE INVENTION

Figure 1:
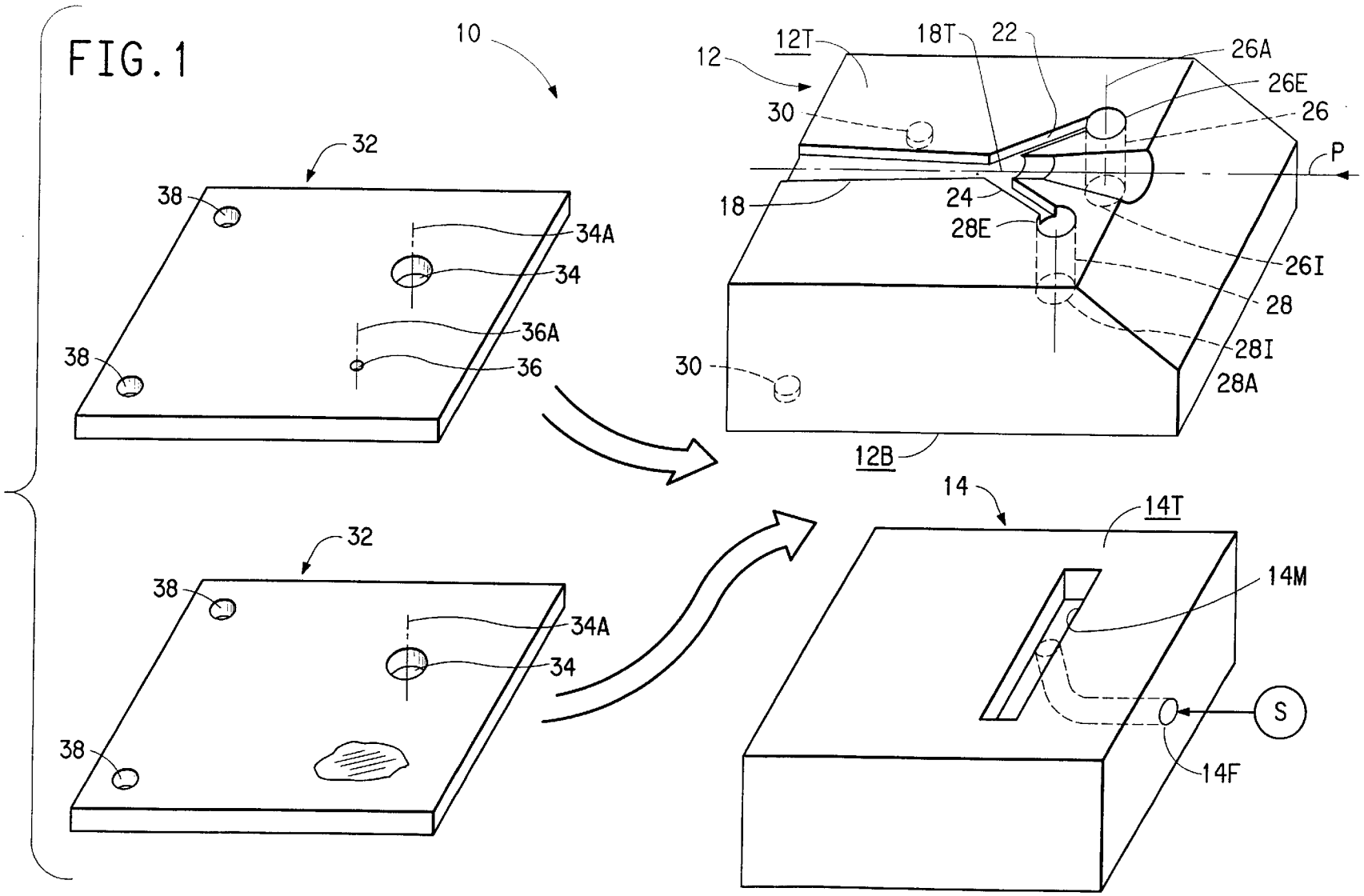
FIG. 1 is an exploded, perspective view of a fluid treatment jet body and associated manifold body as used in a typical spinning process for imparting bulk and interlace to a multifilament melt-spun yarn, with two alternative structures of flow adjustment plates in accordance with the present invention.

Throughout the following detailed description, similar reference numerals refer to similar elements in all figures of the drawings.

As seen in FIG. 1 a jet generally indicated by the reference character 10 for treating a yarn with a pressurized fluid, such as hot gas or stream, includes a jet body 12 and an associated conjoinable manifold body 14. The jet body 12 has a first, top surface 12T and an opposed, second, or bottom surface 12B thereon. When attached to the jet body 12 the upper surface 14T of the manifold body 14 confronts the bottom surface 12B of the jet body. The manifold body 14 has a fluid supply manifold 14M formed in the top surface 14T thereof. The manifold 14M is connected via a suitable supply fitting diagrammatically indicated at 14F, whereby the manifold 14M may be connected to a source S of pressurized treatment fluid.

The jet 10 further includes a detachable cover (not shown) that is secured along an interface defined by the top surface 12T of the jet body 12. Since it is not germane to the discussion of the present invention the cover is omitted from the drawing for economy of illustration. The jet body 12 is secured to the manifold body 14 such that the surfaces 12B and 14T are in the confrontational relationship. Any suitable expedient may be used to secure the cover to the jet body and the jet body to the manifold body and remain within the contemplation of the present invention. For example, a threaded fastener may extend through aligned bores provided in the cover and the jet body. The same fastener may also be used, if desired, to connect the jet body to the manifold body, or a separate fastener may be provided for this purpose. Suitable locator dowel pins or the like may be conveniently used to position the cover, the jet body and the manifold body with respect to each other.

At least one yarn passage 18 is formed in the top surface 12T of the jet body 12. First and a second fluid conduits 22, 24, respectively are also formed in the top surface 12T of the jet body 12. Each fluid conduit 22, 24 intersects the yarn passage 18 in the throat region 18T. The fluid conduit 22, 24 conduct treatment fluid to the yarn passage 18.

First and second fluid supply channels 26, 28, respectively, are also formed in the jet body 12. Although shown in the drawings as cylindrical bores, the fluid supply channels 26, 28 may flare outwardly as they extend through the jet body 12 from the top surface 12T of the bottom surface 12B. Each channel 26, 28 has a respective central longitudinal axis 26A, 26B therethrough. The channels may flare outwardly as the proceed from the top surface 12T to the bottom surface 12B. Each fluid supply channel 26, 28 has an outlet end E that opens near the top surface 12T of the jet body 12 and an inlet end I that opens at the bottom surface 12B of the jet body 12. The outlet end 26E, 28E of each fluid supply channel 26, 28 is in fluid communication with a respective one of the fluid supply conduits 22, 24. The inlet end 26I, 28I of each fluid supply channel 26, 28 has a predetermined fluid flow area associated therewith. When the jet body 12 and the manifold body 14 are secured together the inlet end 26I, 28I of each of the fluid supply channels 26, 28 is positioned to lie in fluid communication with the supply manifold 14M. The bottom surface 12B of the jet body 12 (and/or the top surface of the manifold body 14) has positioning dowels 30 formed thereon, for a purpose to be discussed.

As is well known in the art, the configuration and dimensioning of the various portions of the yarn passage 18, the fluid conduits 22, 24, and the fluid channels 26, 28 are selected such that a predetermined flow of pressurized treatment fluid is conducted in a balanced fashion into the throat region 18T of the yarn passage 18. The treatment fluid on opposed sides of a yarn as the yarn is conducted along a path of travel P through the yarn passage 18. Typically, the cross sections of the throat 18T of the yarn passage 18 and of the fluid conduits 22, 24 are substantially rectangular.

The flow characteristics of the treatment fluid impinging on opposed sides of the yarn conducted through the throat region 18T imparts a predetermined level of interlace to the filaments of the yarn. As noted earlier, in some instances it may desirable to modify the level of interlace imparted to the yarn as it passes through the jet 10. The present invention is directed to an arrangement that serves to unbalance the fluid flow into the throat of the yarn passage and thereby modifies the interlace level imparted to the yarn.

A jet 10 in accordance with the present invention includes a flow control plate generally indicated by the reference character 32 that is mounted between the jet body and the manifold body. In the preferred embodiment the plate 32 has a first and a second flow control opening 34, 36 therein. Each flow control opening 34, 36 has a respective axis 34A, 36A extending therethrough. As will be developed by the specific examples set forth herein the flow control openings 34, 36 are located in the plate 32 such that when the plate 32 is mounted between the jet body 12 and the manifold body 14 at least one of the openings 34, 36 in the plate 32 at least partially overlaps the inlet end I of one of the fluid supply channels 26, 28, as the case may be, thereby to modify the fluid flow area presented to the manifold 14M by that fluid supply channel. Modification of the flow area presented to the manifold has the effect of altering the pressure of the treatment fluid introduced into the channel. Positioning openings 38 are provided in the plate 32 to receive the positioning dowels 30 that are formed on the jet body 12 and/or the manifold body 14 to locate the plate 32 with respect thereto. Of course any alternative expedient may be used to position the flow control openings 34, 36 in the plate 32 with respect to the inlet of the channels in the jet body 12 and remain within the contemplation of the present invention.

The plate 32 is a relatively thin planar member that may be fabricated from any suitable engineering material, with metal, specifically AISI 316 stainless steel, being preferred. The flow openings 34, 36 and the positioning openings 38 are machined into the plate 32

Details of the invention will be more fully understood with reference to FIGS. 2A through 2E, which are diagrammatic plan views showing various alternative arrangements of a flow control plate 10 in accordance with the present invention. In each of the views 2A through 2E, the fluid supply channels 26, 28 are illustrated in solid lines, while the boundaries of the flow control openings in the plate 32 are shown in dashed lines.

Figure 2A:
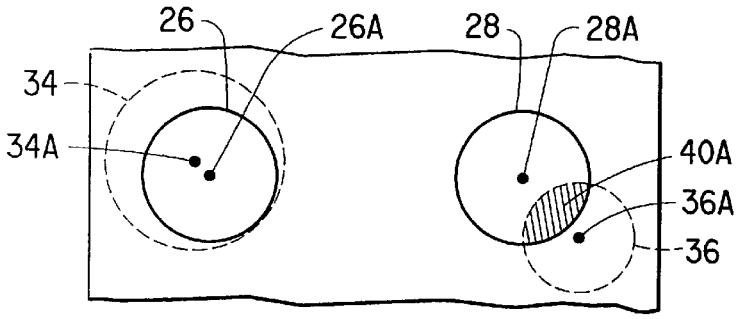
FIGS. 2A through 2E are diagrammatic plan views of various embodiments of a flow control plate having different arrangements of flow control openings formed therein; and, FIG. 3 is a diagrammatic plan view illustrating the flow control plate of the present invention in use in conjunction with a jet body having a plurality of yarn passages formed therein.

In FIG. 2A the opening 34 in the flow control plate 10 has a flow area that is greater than the fluid flow area of its associated channel 26. Conversely, the opening 36 in the flow control plate 10 has a flow area that is less than the fluid flow area of its associated channel 28. The openings 34, 36 are positioned in the plate 32 such that the opening 34 totally overlaps the inlet end 26I of the channel 28 and the opening 36 at least partially overlaps the inlet end 28I of the channel 28. Owing to the relative positioning of the opening 34 with respect to the inlet end 26I of the channel 26 and their relative sizes, the full flow area of the channel 26 is presented to the manifold 14M. Thus, the flow of treatment fluid through the channel 26 is not affected by the presence of the plate 32. However, since the opening 36 at least partially overlaps the inlet end 28I of the channel 28 only that portion of the flow area indicated by the cross hatching 40A is presented to the manifold 14M. Thus, the pressure of the treatment fluid flowing into the channel 28 and to the conduit 24 is diminished, resulting in an unbalance in the flow of treatment fluid to the yarn passage.

Various modifications of the plate 32 disclosed in FIG. 2A within the contemplation of the present invention immediately present themselves. It is noted that in FIG. 2A the axis 34A of the opening 34 is offset from (i. e., not collinear with) the axis 26A of the channel 26. However, it should be understood that the opening 34 may be positioned in the plate 32 so that its axis 34A is collinear with the axis 26A if desired. It should also be understood that although the configurations of the channels 26, 28 and the openings 34, 36 are all circular, each of the channels 26, 28 and the openings 34, 36 may be otherwise configured and remain within the contemplation of the present invention. In FIG. 2A the opening 34 has a flow area that is greater than the flow area of the corresponding channel 26. However, if the opening 34 was made equal in flow area and identical in configuration, in which case the opening 34 must be positioned with its axis collinear to the axis 26A for the flow through the channel 26 to remain unaffected by the presence of the plate 32. The opening 36 (which partially overlaps the inlet end of the opening 28) is shown as having a flow area that is smaller than the flow area of the opening 28 with which it is associated. It should be appreciated that the opening 36 may be greater than, less than, or equal to the flow area of the opening 36, if desired, so long as it is appropriately positioned so as to provide the partial overlap illustrated in FIG. 2A. In addition, the flow areas of the openings 34, 36 may be the same or different in size.

Figure 2B:
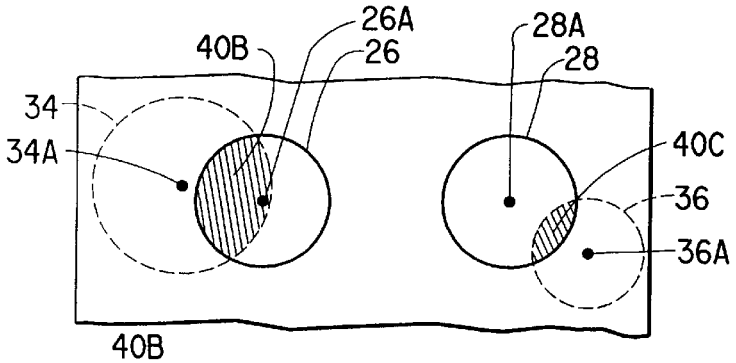

FIG. 2B depicts a situation in which both the openings 34 and the opening 36 in the flow control plate 10 each at least partially overlap the inlet end 26I, 28I of the respective channels 26, 28. In this event, only that portion of the flow area of the channels 26, 28 indicated by the cross hatching 40B, 40C would be presented to the manifold 14M. It is important to note in this instance that the area of overlap 40B between the opening 34 and the channel 26 is different from area of overlap 40C between the opening 36 and the channel 28. Thus, the treatment fluid flow into the channels 26, 28 and to their associated conduits 22, 24 would be diminished, again resulting in an unbalance in the flow of treatment fluid to the yarn passage. It may again be appreciated that various modifications may be implemented if desired. For example, the axes 34A, 36A of the openings 34, 36 may be collinear with or offset from (i. e., not collinear with) the axes 26A, 28A. The configurations of the channels 26, 28 and the openings 34, 36 may be similarly or differently configured. In addition, the flow areas of the openings 34, 36 may be greater than, less than or equal to the flow area of the corresponding channel 26, 28. The sizes of the flow areas of the openings 34 36 may be the same or different from each other, again so long as they are appropriately positioned so as to provide the partial overlaps illustrated in FIG. 2B.

Figure 2C:
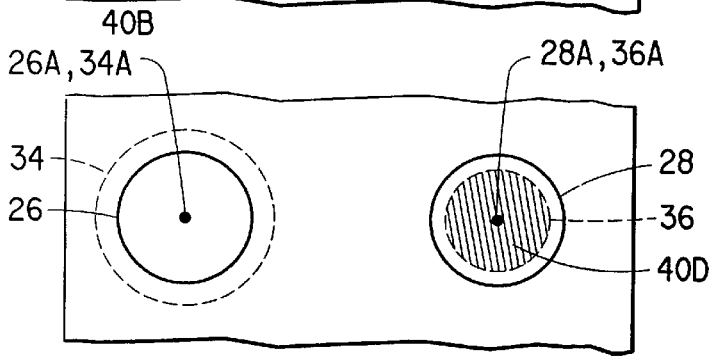

FIG. 2C illustrates yet another alternative implementation of the present invention. In this instance the flow control openings 34, 36 are located in the plate 32 such that when the plate 32 is mounted between the jet body 12 and the manifold body 14 both of the openings 34, 36 register with the inlet end of one of the fluid supply conduits with the axis 34A, 36A of each opening 34, 36 being collinear with the respective axis 26A, 28A of the supply channel 26, 28 with which it is registered. The opening 34 is sized such that its flow area is greater than or equal to the flow area of the inlet end of the channel 26 with which it is registered, while the opening 36 is sized such that its flow area is smaller than the flow area of the inlet end of the channel 28 with which it is registered. Thus, at least one of the openings (e. g., the opening 36) has a fluid flow area that is smaller than the fluid flow area presented to the manifold by the fluid supply channel 28. Accordingly, only that portion of the flow area indicated by the cross hatching 40D is presented to the manifold 14M. In FIG. 2C, since the other opening 34 is sized such that its flow area is greater than or equal to the flow area of the channel 26 with which it is registered, a flow imbalance to the passage 18 is generated.

Figure 2D:
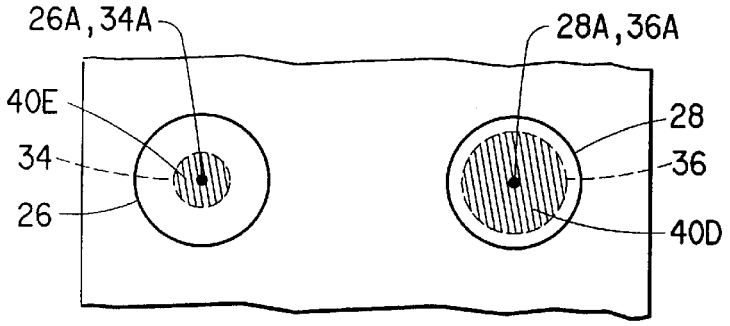

As illustrated in FIG. 2D, if the flow area of the opening 34 is also less than the flow area of the channel 26 with which it is registered, only that portion of the flow area thereof indicated by the cross hatching 40E is presented to the manifold 14M. However, for a flow imbalance to be generated, the flow area 40E must be different from area of overlap 40D. (The relationship of the opening 36 and the channel 28 in FIG. 2D is the same as illustrated in FIG. 2C.)

Figure 2E:
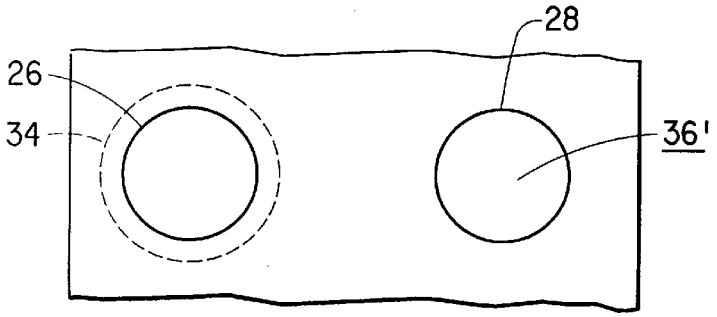

FIG. 2E illustrates a further modification of the plate structure that lies within the contemplation of the present invention. The embodiment shown in FIG. 2E facilitates the conversion of a dual impingement jet into a single impingement jet. In the embodiment of FIG. 2E only a single opening 34 is provided in the plate 32. With the plate 32 positioned between the jet body 12 and the manifold body 14 the channel 28 is totally obstructed by the portion 36' of the surface of the plate 32. The plate 32 is positioned such that the flow area of the channel 26 remains either unobstructed or only partially obstructed by overlap with the opening 34.

It should also be apparent from the foregoing that a plurality of separate flow control plates may be fabricated, each exhibiting any of the above-described arrangements of openings therein. Moreover, each of such flow control plates may be selectably inserted into the jet 10 between the jet body 12 and the manifold body 14, thereby to modify the interlace characteristics imparted by the jet 10.

The flow control plate in accordance with the present invention is believed advantageous in that it permits control of the treatment fluid pressure and fluid flow at the manifold, and does not require modifications to the jet body 12 or the manifold body 14. It should be appreciated by those skilled in the art that, at a given pressure, as treatment fluid flow and interlace is reduced, the bulk imparted to the yarn may also be diminished. Accordingly, to restore the desired bulk level at the reduced level of interlace, other process parameters may have to be adjusted.

Figure 3:
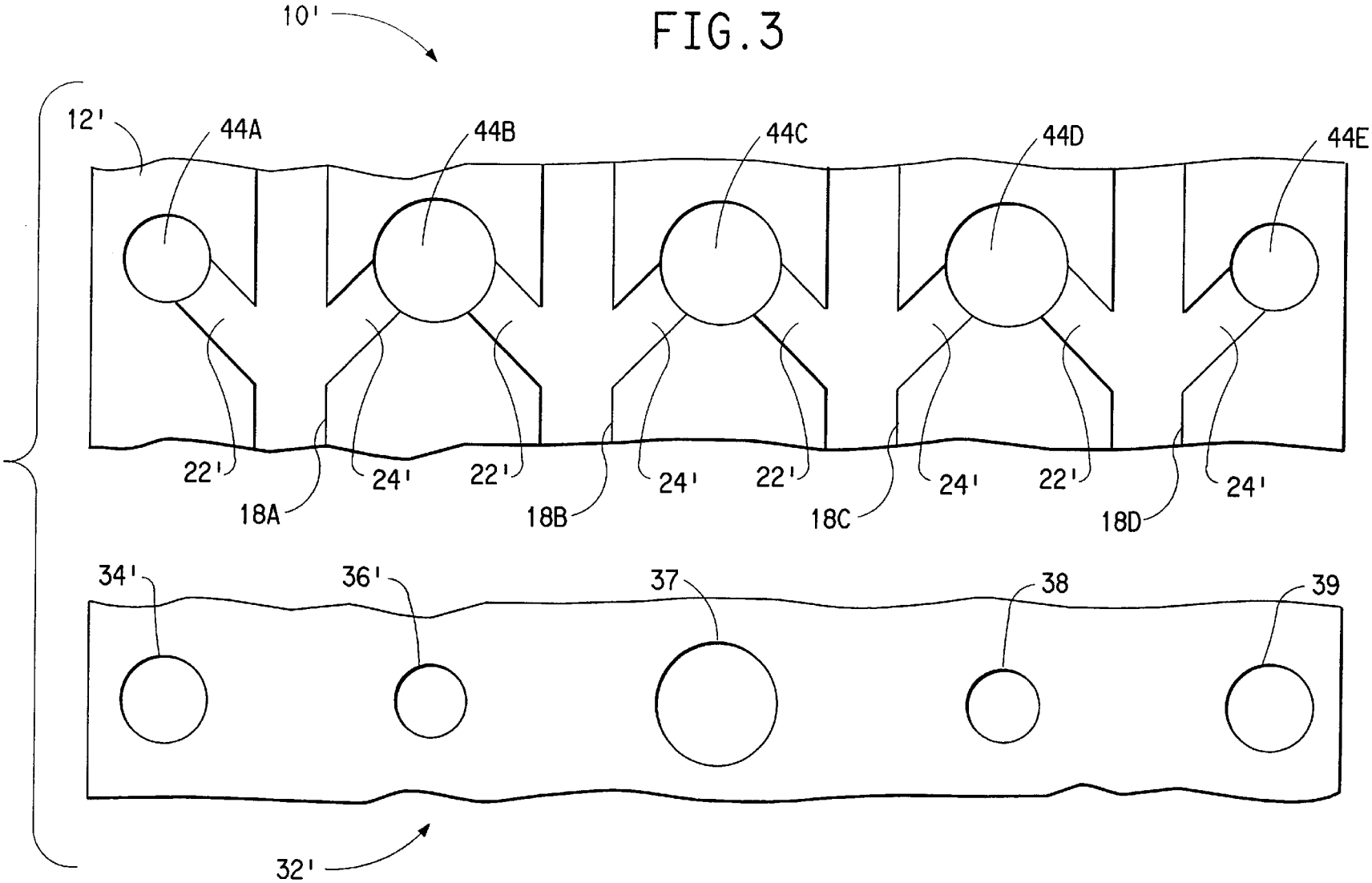

FIG. 3 is a diagrammatic plan view illustrating the use of a flow control plate 32' embodying the teachings of the present invention in use with a jet 10' of the type having multiple balanced yarn passages 18A through 18D formed in the jet body 12' thereof. The jet body 12' and the plate 32' are each shown in plan view. Each passage18A through 18D has associated conduits 22' 24' associated therewith. In the jet 10' the flow channels 44A, 44E at the extreme lateral ends of the jet body 12' service only the proximal yarn passage 18A, 18D, respectively. These flow channels 44A, 44E have a first predetermined flow area associated therewith. The flow channels 44B, 44C and 44D lie intermediate yarn passages 18A, 18B, 18C and 18D. Each of these flow channels 44B, 44C and 44D is called upon to service both of adjacent yarn passages. Accordingly, each of the channels 44B, 44C and 44D has a second predetermined flow area associated therewith. The relative flow area of the channel 44A or 44E with respect to the flow area of a channel 44B, 44C, or 44D are selected such that a balanced flow is provided to each of the yarn passages 18A through 18D.

The plate 32' in accordance with the present invention has five flow control openings 34', 36', 37, 38 and 39 formed therein. When the plate 32' is positioned between the jet body 12' and its corresponding manifold body in the manner discussed herein, each opening 34', 36', 37, 38 and 39 is respectively associated with the inlet end of flow channels 44A, 44B, 44C, 44D and 44E. In this application of the present invention, the plate 32' is positioned such that the axes of the openings in the plate are collinear with the axes of the channels. The openings 34', 37 and 39 have the same flow area as the flow area of the inlet ends of the channels 44A, 44C and 44E to which they correspond. The openings 36' and 38 are equal in size to each other, and are each smaller in flow area that the flow area at the inlet end of the channels 44B, 44D with which these openings correspond. Thus, a situation similar to that as discussed in connection with FIG. 2C is defined for each adjacent pair of flow control openings and their associated flow channels. It should be appreciated that by making the flow area of only two of the five flow control openings (i. e., the openings 36', 38) less than the flow area presented by the flow channels with which these two openings are associated, the flow to all four of the yarn passages 18A through 18D may be unbalanced. By fabricating a plurality of plates 32' (in which equally sized openings 36', 38 overlap with their associated channels 44B, 44D to a different degree) a variety of interlace levels may be achieved from the same jet 12'.

Those skilled in the art, having the benefit of the teachings of the present invention as hereinabove set forth may impart numerous modifications thereto. These modifications are to be construed as lying within the scope of the present invention, as defined by the appended claims.

What is claimed is:

1. In a jet for treating a yarn with a pressurized fluid, the jet having:

a jet body having a first and a second surface thereon, at least one yarn passage formed in the first surface of the body, a first and a second fluid conduit formed in the first surface of the jet body, each fluid conduit intersecting the yarn passage for conducting a treatment fluid thereto, a first and a second fluid supply channel extending through the jet body from the first to the second surface, each fluid supply channel having an inlet end and an outlet end, the outlet end of each fluid supply channel being in fluid communication with a respective one of the fluid supply conduits, the inlet end of each fluid supply channel having a predetermined fluid flow area associated therewith, and a manifold body having a fluid supply manifold therein, the inlet end of each of the first and the second fluid supply channels being in fluid communication with the supply manifold, the improvement comprising:

a plate having a first and a second flow control opening therein, the flow control openings being located in the plate such that when the plate is mounted between the jet body and the manifold body at least one opening in the plate at least partially overlaps the inlet end of one of the fluid supply channels to modify the fluid flow area presented to the manifold by that fluid supply channel.

2. The jet of claim 1 wherein the second flow control opening is located in the plate such that when the plate is mounted between the jet body and the manifold body the second opening in the plate also at least partially overlaps the inlet end of the other fluid supply channel to modify the fluid flow area presented to the manifold by that fluid supply channel, the degree of overlap of the first opening and the fluid supply channel with which it is associated being different from the degree of overlap of the second opening and the fluid supply channel with which it is associated.

3. In a jet for treating a yarn with a pressurized fluid, the jet having:

a jet body having a first and a second surface thereon, at least one yarn passage formed in the first surface of the body, a first and a second fluid conduit formed in the first surface of the jet body, each fluid conduit intersecting the yarn passage for conducting a treatment fluid thereto, a first and a second fluid supply channel extending through the jet body from the first to the second surface, each fluid supply channel having an inlet end and an outlet end and having an axis therethrough, the outlet end of each fluid supply channel being in fluid communication with a respective one of the fluid supply conduits, the inlet end of each fluid supply channel having a predetermined fluid flow area associated therewith, and a manifold body having a fluid supply manifold therein, the inlet end of each of the first and the second fluid supply channels being in fluid communication with the supply manifold, the improvement comprising:

a plate having a first and a second flow control opening therein, each flow control opening having an axis, the flow control openings being located in the plate such that when the plate is mounted between the jet body and the manifold body each of the openings in the plate register with the inlet end of one of the fluid supply conduits such that the axis of each opening is collinear with the axis of the supply channel with which it is registered, the first opening having a fluid flow area that is smaller than the fluid flow area presented to the manifold by the fluid supply channel with which it is registered.

4. The jet of claim 3, wherein the second opening in the plate has a fluid flow area that is smaller than the fluid flow area presented to the manifold by the fluid supply channel with which the second opening is registered.

5. The jet of claim 4, wherein the fluid flow area of the first opening in the plate is different from the fluid flow area of the second opening in the plate.

6. In a jet for treating a yarn with a pressurized fluid, the jet having:

a jet body having a first and a second surface thereon, at least one yarn passage formed in the first surface of the body, a first and a second fluid supply conduit formed in the first surface of the jet body, each fluid supply conduit intersecting the yarn passage for conducting a treatment fluid thereto, a first and a second fluid supply channel extending through the jet body from the first to the second surface, each fluid supply channel having an inlet end and an outlet end, the outlet end of each fluid supply channel being in fluid communication with a respective one of the fluid supply conduits, the inlet end of each fluid supply channel having a predetermined fluid flow area associated therewith, and a manifold body having a fluid supply manifold therein, the inlet end of each of the first and the second fluid supply channels being in fluid communication with the supply manifold, the improvement comprising:

a plate having a flow control opening therethrough, the flow control opening being located in the plate such that when the plate is mounted intermediate the jet body and the manifold body the inlet end of one of the fluid supply channels communicates with the opening in the plate and the inlet end of the other fluid supply channel is blocked by the plate.

7. The jet of claim 6, wherein the opening in the plate is sized such that when the plate is mounted intermediate the jet body and the manifold body the full fluid flow area of the channel is presented to the manifold.

8. The jet of claim 6, wherein the opening in the plate has a fluid flow area that is smaller than the fluid flow of the channel so that when the plate is mounted intermediate the jet body and the manifold body the fluid flow area of the channel that is presented to the manifold is diminished.

* * * * *